US011661224B2

(12) United States Patent
Thürig et al.

(10) Patent No.: US 11,661,224 B2
(45) Date of Patent: May 30, 2023

(54) APPARATUS FOR HEAT SHRINKING A PACKAGE AND METHOD FOR HEAT SHRINKING A PACKAGE

(71) Applicant: Cryovac, LLC, Charlotte, NC (US)

(72) Inventors: Peter Thürig, Eich (CH); Stefan Landolt, Obernau (CH); Gregory Edward McDonald, Marvin, NC (US)

(73) Assignee: Cryovac, LLC, Charlotte, NC (US)

( * ) Notice: Subject to any disclaimer, the term of this patent is extended or adjusted under 35 U.S.C. 154(b) by 511 days.

(21) Appl. No.: 16/471,028

(22) PCT Filed: Dec. 21, 2017

(86) PCT No.: PCT/EP2017/084026
§ 371 (c)(1),
(2) Date: Jun. 19, 2019

(87) PCT Pub. No.: WO2018/115246
PCT Pub. Date: Jun. 28, 2018

(65) Prior Publication Data

US 2020/0108964 A1 Apr. 9, 2020

(30) Foreign Application Priority Data

Dec. 21, 2016 (EP) ..... 16205638

(51) Int. Cl.
*B65B 53/04* (2006.01)
*B65B 9/02* (2006.01)
*B65B 53/06* (2006.01)

(52) U.S. Cl.
CPC ..... *B65B 53/04* (2013.01); *B65B 9/02* (2013.01); *B65B 53/063* (2013.01)

(58) Field of Classification Search
CPC ..... B65B 53/04; B65B 9/02; B65B 53/063
See application file for complete search history.

(56) References Cited

U.S. PATENT DOCUMENTS 2,789,407 A * 4/1957 Smallegan ..... B65B 53/04 53/557
3,312,811 A * 4/1967 Shanklin ..... B65B 53/063 219/388

(Continued)

FOREIGN PATENT DOCUMENTS

EP 2551207 A1 1/2013
EP 2626308 A1 8/2013

(Continued)

*Primary Examiner* — Joshua G Kotis
*Assistant Examiner* — Katie L Gerth
(74) *Attorney, Agent, or Firm* — Jon M Isaacson

(57) ABSTRACT

An apparatus for heat shrinking packages includes a mover having an active surface configured for receiving one or more packages and for displacing the one or more packages along a predetermined operating path, a heating fluid circuit configured to circulate a heating fluid, a control unit operative on the heating fluid circuit, the control unit being configured to control circulation of the heating fluid in the heating fluid circuit, a chamber having an opening and being configured for receiving the one or more packages positioned on the active surface and for heat shrinking the one or more packages based on circulation of the heating fluid in the heating fluid circuit, and means for forming a liquid curtain arranged at the opening and configured to define a liquid curtain along the opening, the liquid curtain separating an inner volume of the chamber from an ambient atmosphere external to the chamber.

18 Claims, 4 Drawing Sheets

(56) References Cited

U.S. PATENT DOCUMENTS 3,399,506 A * 9/1968 Howe, Jr. ..... B65B 53/063 53/442
3,678,244 A * 7/1972 Worline ..... B65B 53/063 219/388
3,727,324 A * 4/1973 Melgaard ..... B65B 53/063 34/216
4,738,082 A * 4/1988 Saitoh ..... B65B 53/063 53/557
5,062,217 A * 11/1991 Tolson ..... B65B 53/063 34/443
5,193,290 A * 3/1993 Tolson ..... B65B 53/02 34/216
5,398,427 A * 3/1995 Tolson ..... B65B 53/02 34/216
5,400,570 A * 3/1995 Bennett ..... B65B 53/04 34/216
5,699,650 A * 12/1997 Gray ..... B65B 53/04 53/442
5,740,659 A * 4/1998 Cox ..... B65B 53/04 53/216
8,235,712 B1 * 8/2012 Lewis ..... B65B 53/02 432/121
9,517,853 B2 * 12/2016 Koolhaas ..... B65B 21/245
10,011,382 B2 * 7/2018 Schilling ..... B65B 35/44
2011/0232239 A1 * 9/2011 Winter ..... B65G 15/16 53/509
2015/0040520 A1 * 2/2015 Landolt ..... F28D 21/0014 53/442
2015/0147449 A1 * 5/2015 Johnson ..... B65B 31/028 426/395

FOREIGN PATENT DOCUMENTS

EP 2722280 A1 4/2014
EP 2993042 A1 3/2016
GB 645079 A 10/1950
WO 9011223 A1 10/1990
WO 2006111148 A1 10/2006

* cited by examiner

APPARATUS FOR HEAT SHRINKING A PACKAGE AND METHOD FOR HEAT SHRINKING A PACKAGE

TECHNICAL FIELD

The present invention relates to an apparatus for heat shrinking a package and a method for heat shrinking a package.

BACKGROUND ART

An apparatus and method for heat shrinking a package may be used to heat shrink a package. Such a method may be performed in the context of packaging food products, for example meat or cheese. The food product can be packaged in a heat shrinkable material, where the heat shrinkable material is provided in a manner receiving the food product directly (e.g. within a bag formed from a tubular supply of heat shrinkable film material) or on a tray or other support (e.g. the film encompassing the product placed on the support). The heat shrinkable material is shrunk around the support and/or food product within the apparatus. The apparatus may be referred to as a shrink tunnel or shrink tank. Heat shrinking the film may entail several effects, for example properly sealing the package, improving its appearance, reducing the volume of residual air or gas contained within the package, reducing deterioration of the food product, increasing shelf life, and reducing storage space required for the package.

An apparatus for heat shrinking a package may be configured to employ hot fluid (e.g. air, water vapor, water) being applied to a package, causing the material to shrink around the food. The packages are typically provided to the apparatus using a supply belt transporting the packages towards the apparatus and onto a conveyor belt operating within the apparatus. The conveyor belt inside the apparatus is configured to receive the supplied packages and to transport the packages into and through the apparatus, before handing the packages over to an exit belt, where the shrunk packages are received.

When packaging refrigerated goods (e.g. meat, cheese), the shrinking process taking place within the apparatus may be impaired or stopped once the packaging material contacts food having a low temperature. Such incomplete shrinking may result in a package being not properly sealed and/or being aesthetically displeasing. In other apparatuses, packages are subjected to immersion in a water bath or passage through a water curtain, sometimes in addition to the application of hot air or steam. The application of water can at least partly overcome the problem of incomplete shrinking. However, immersion in water and the use of hot water curtains requires a large amount of energy, particularly in the initial stages of using the apparatus when the water must be heated to a high temperature (the water must also be subsequently maintained at a high temperature).

In this document, embodiments and examples are described on the basis of hot water curtains (e.g. used for heat shrinking packages) and cold water curtains. It is noted that the use of the terms "hot water" and "cold water" does not preclude other fluids or liquids being used unless specifically stated otherwise. Therefore, all embodiments and examples may be implemented using heating fluids (e.g. hot water or other liquid) and cooling fluid (e.g. cold water or other liquid) other than more specific terms used in this description.

Irrespective of the shrinking medium employed (e.g. air, water vapor, water curtain, water bath), large amounts of fluid being heated and circulated within the chamber may lead to substantial heat loss, primarily by heated air and/or steam escaping from the chamber through inlet and outlet openings at which packages are received and ejected. Inlet and outlet openings are typically sized to accommodate packages having different sizes and are, thus, typically relatively large in order not to restrict the maximum size of packages that can be processed with the apparatus. Such large openings consequently present substantial passageways for heated air or steam to escape the chamber, resulting in corresponding heat loss from the system.

In order to prevent heat loss at the inlet and outlet openings, prior art solutions have employed plastic curtains arranged at the inlet and outlet openings and configured to yield to incoming and outgoing packages. In some examples, the plastic curtains are provided in form of flexible panels or doors configured to swing open upon contact with a respective package. In other examples, the plastic curtains are provided as a series of plastic bands placed side by side in order to occlude the inlet or outlet openings in the form of vertical strips. Upon a package contacting one or more of the plastic bands, the band or bands can yield to the package while the package enters the chamber or exits therefrom.

Issues with such solutions include that the plastic material needs to be very flexible even at low temperatures (e.g. around or below 5° C.), typically requiring the material to be rather light and thin, and still have very good insulating properties, typically requiring the material to be rather strong and thick. Such conflicting requirements can be difficult to weigh against each other, in particular for different types of packages (e.g. with respect to weight, size, shape). Additionally, packaging very light products may require the curtains to be removed altogether, if the weight of the package is not sufficiently high in order to push the plastic curtain out of the way. Irrespective of the individual manner the plastic curtains are provided, there may still be substantial heat loss by air or steam escaping through the curtains during entry of a package into the chamber or exit therefrom.

An aim of the present invention is to provide an apparatus for heat shrinking a package. Another aim is to provide a method for heat shrinking a package.

SUMMARY OF INVENTION

According to the invention, in a 1$^{st}$ aspect there is provided an apparatus for heat shrinking packages, comprising means for moving having an active surface configured for receiving one or more packages and for displacing the one or more packages along a predetermined operating path, a heating fluid circuit configured to circulate a heating fluid, a control unit operative on the heating fluid circuit, the control unit being configured to control circulation of the heating fluid in the heating fluid circuit, a chamber having an opening and being configured for receiving the one or more packages positioned on the active surface and for heat shrinking the one or more packages based on circulation of the heating fluid in the heating fluid circuit, and means for forming a liquid curtain arranged at the opening and configured to define a liquid curtain along the opening, the liquid curtain separating an inner volume of the chamber from an ambient atmosphere external to the chamber. Optionally, the apparatus further comprises a cooling liquid circuit configured to circulate a cooling liquid, and the control unit is operative on the cooling liquid circuit and configured to control circulation of the cooling liquid in the cooling liquid circuit. The control unit is further optionally configured to control the cooling liquid circuit to supply the cooling liquid to the means for forming the liquid curtain.

In a $2^{nd}$ aspect according to the preceding aspect, the means for forming the liquid curtain comprise an upper reservoir and a lower reservoir, and the means for forming the liquid curtain are configured to create, under gravity, the liquid curtain in the form of a substantially continuous wall of liquid extending between the upper reservoir and the lower reservoir based on a substantially continuous supply of cooling liquid from the cooling liquid circuit, thereby separating the inner volume of the chamber from the ambient atmosphere external to the chamber. Optionally, separating the inner volume of the chamber from the ambient atmosphere external to the chamber includes substantially limiting or preventing fluid communication through the opening.

In a $3^{rd}$ aspect according to the preceding aspect, the control unit is configured to control the substantially continuous supply of cooling liquid from the cooling liquid circuit to the means for forming the liquid curtain.

In a $4^{th}$ aspect according to any one of the two preceding aspects, the upper reservoir and the lower reservoir are relatively positioned with respect to one another so as to cause, under the substantially continuous supply of cooling liquid from the cooling liquid circuit to the upper reservoir, flow of the cooling liquid over an outer edge of the upper reservoir and into the lower reservoir, thereby forming the substantially continuous wall of liquid extending between the upper reservoir and the lower reservoir.

In a $5^{th}$ aspect according to the preceding aspect, the outer edge of the upper reservoir extends substantially straight and substantially horizontally.

In a $6^{th}$ aspect according to aspects 2 to 5, the upper reservoir has a first end and a second end and is positioned relative to the apparatus such that the first end of the upper reservoir is positioned proximate to or within the chamber and such that the second end of the upper reservoir is positioned distal to the chamber, the outer edge of the upper reservoir being located at the second end of the upper reservoir and, preferably, directly above the lower reservoir. Optionally, the lower reservoir has a first end and a second end and is positioned relative to the apparatus such that the first end of the lower reservoir is positioned proximate to or within the chamber and such that the second end of the lower reservoir is positioned distal to the chamber, the second end of the lower reservoir being located from the chamber at a greater distance that the second end of the upper reservoir.

In a $7^{th}$ aspect according to aspects 2 to 6, the upper reservoir is configured to hold a volume of the cooling liquid and/or the lower reservoir is configured to hold a volume of the cooling liquid.

In an $8^{th}$ aspect according to aspects 2 to 7, the means for forming the liquid curtain further comprise at least two panels configured to laterally guide the cooling liquid and extending laterally to a region in which the liquid curtain is formed between the upper reservoir and the lower reservoir.

In a $9^{th}$ aspect according to the preceding aspect, the at least two panels are arranged in a funnel-shaped configuration in which respective upper ends of the at least two panels are spaced further apart from one another than respective lower ends of the at least two panels. Optionally, the at least two panels form lateral boundary surfaces limiting a lateral extension of the liquid curtain.

In a $10^{th}$ aspect according to any one of the two preceding aspects, each of the at least two panels is arranged at an inclination angle of about 75° to 85° with respect to a horizontal plane substantially parallel to the active surface, preferably wherein the inclination angle is about 80°.

In an $11^{th}$ aspect according to any one of the preceding aspects, the cooling liquid circuit comprises a cooling liquid tank, a pump, and a cooling liquid supply line. The control unit is configured to control the pump in order to cause controlled supply of the cooling liquid to the means for forming the liquid curtain via the cooling liquid supply line.

In a $12^{th}$ aspect according to any one of the preceding aspects, the means for forming the liquid curtain are arranged outside of the chamber substantially adjacent the opening.

In a $13^{th}$ aspect according to any one of aspects 1 to 11, the means for forming the liquid curtain are arranged inside of the chamber substantially adjacent the opening.

In a $14^{th}$ aspect according to any one of the preceding aspects, the apparatus further comprises a heat pump. The control unit is further configured to control the heat pump to cause transfer of heat energy from the cooling liquid circulating in the cooling liquid circuit to the heating fluid circulating in the heating fluid circuit.

In a $15^{th}$ aspect according to the preceding aspect, the heat pump comprises a heat pump circuit configured to circulate a working fluid, the heat pump circuit comprising a first heat exchanger, a second heat exchanger, an expansion valve, and a compressor. The first heat exchanger is configured to transfer heat from the cooling liquid circulating in the cooling liquid circuit to the working fluid circulating in the heat pump circuit. The second heat exchanger is configured to transfer heat from the working fluid circulating in the heat pump circuit to the heating fluid circulating in the heating fluid circuit. The control unit is configured to control the expansion valve and/or the compressor in order to cause heat energy transfer from the cooling liquid circulating in the cooling liquid circuit to the heating fluid circulating in the heating fluid circuit via the working fluid circulating in the heat pump circuit.

In a $16^{th}$ aspect according to any one of the preceding aspects, the means for moving comprise a conveyor belt, the control unit is further configured to control the conveyor belt in order to transport packages into and/or out from the chamber, and the active surface includes an upper surface of the conveyor belt. Optionally, the active surface comprises a mesh, or holes, and/or is porous such that the heating fluid and/or the cooling liquid can pass through the active surface.

In a $17^{th}$ aspect according to any one of the preceding aspects, the chamber further has a second opening and is configured for receiving one or more packages through the opening and for allowing the one or more packages to exit the chamber through the second opening. The apparatus further comprises a second means for forming a liquid curtain connected to the cooling liquid circuit, arranged at the second opening, and configured to define a second liquid curtain along the second opening, the liquid curtain and the second liquid curtain separating the inner volume of the chamber from the ambient atmosphere external to the chamber. The control unit is configured to control the cooling liquid circuit to supply the cooling liquid to the means for forming the liquid curtain and to the second means for forming the second liquid curtain.

In an $18^{th}$ aspect according to any one of aspects 16 or 17, the conveyor belt is configured to move packages into the chamber through the opening and to move packages through and out of the chamber through the second opening.

According to the invention, in a 19$^{th}$ aspect there is provided a method for heat shrinking a package, optionally using an apparatus of any one of the preceding claims, the method comprising providing one or more packages on an active surface of means for moving configured for receiving the one or more packages on the active surface and for displacing the one or more packages along a predetermined operating path, defining a liquid curtain along an opening of a chamber of the apparatus, the liquid curtain separating an inner volume of the chamber from an ambient atmosphere external to the chamber, moving the one or more packages through the liquid curtain and through the opening into the chamber, and heat shrinking the one or more packages within the chamber.

In a 20$^{th}$ aspect according to the preceding aspect, the step of defining a liquid curtain comprises providing means for forming a liquid curtain with a substantially continuous supply of a cooling liquid via a cooling liquid circuit configured to circulate the cooling liquid, the means for forming the liquid curtain being arranged at the opening and configured to define the liquid curtain along the opening.

In a 21$^{st}$ aspect according to the preceding aspect, the step of providing the means for forming a liquid curtain with a substantially continuous supply of a cooling liquid comprises controlling the cooling liquid circuit to supply the cooling liquid to the means for forming the liquid curtain.

In a 22$^{nd}$ aspect according to the any one of aspects 19 to 21, the step of heat shrinking the one or more packages comprises controlling a heating fluid circuit configured to circulate a heating fluid to cause application of the heating fluid to the one or more packages.

Advantages of the packaging process and the packaging apparatus include that evacuation of gas/air from a package is performed efficiently while minimizing or eliminating heat loss from fluid and/or liquid in the chamber.

Advantages of the packaging apparatus and the packaging process further include that heat loss from a heat shrinking apparatus is reduced or minimized by limiting or preventing fluid communication between an inner volume of the chamber and an ambient atmosphere outside the chamber.

Advantages of the packaging apparatus and the packaging process also include that heat loss from a heat shrinking apparatus is reduced or minimized by recovering heat energy otherwise emitted from the apparatus and introducing such heat energy at least partly into the heating fluid circuit.

DETAILED DESCRIPTION

Figure 1:
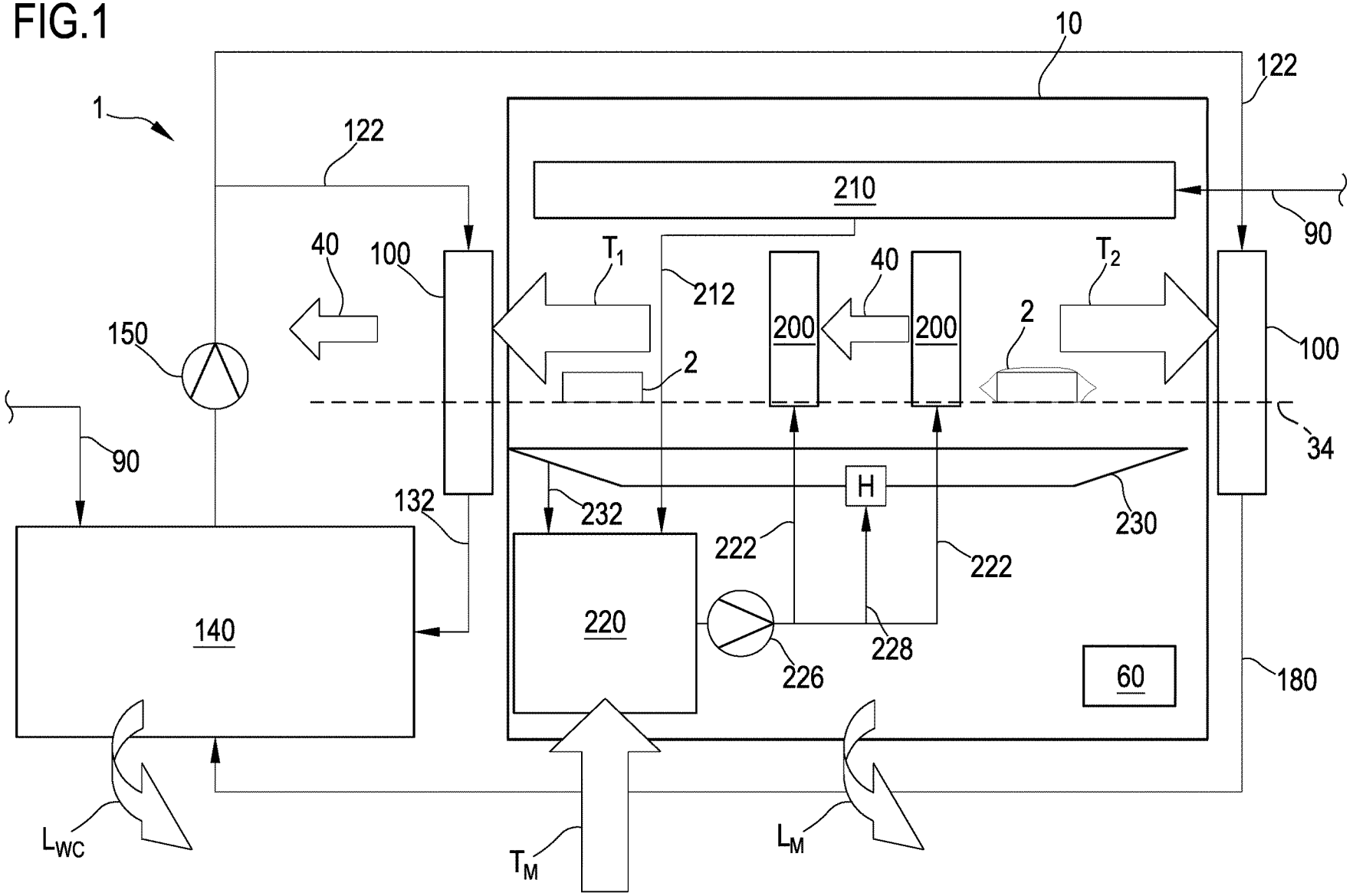
FIG. 1 shows a schematic overview of an apparatus for heat shrinking in accordance with a first embodiment of the present invention.

FIG. 1 shows a schematic overview of an apparatus 1 for heat shrinking in accordance with a first embodiment of the present invention. Apparatus 1 comprises a chamber 10 and a preheat container 210. Chamber 10 is configured such that a package 2 received on a surface 34 of the apparatus may be heat shrunk via a heating fluid in chamber 10. Surface 34 may include an upper run of a conveyor belt 30 (see FIG. 4). It is noted, however, that surface 34 may include any surface configured to support a package 2 within chamber 10. In some embodiments surface 34 is configured to move packages 2 along a main movement direction 40 into and through chamber 10, and further out and away from apparatus 1. Packages 2 can enter chamber 10 through an inlet opening and exit chamber 10 through an outlet opening (both not shown for clarity). The conveyor belt 30 may be configured to extend through chamber 10 or to cooperate with corresponding infeed and outfeed belts (both not shown for clarity).

Figure 2:
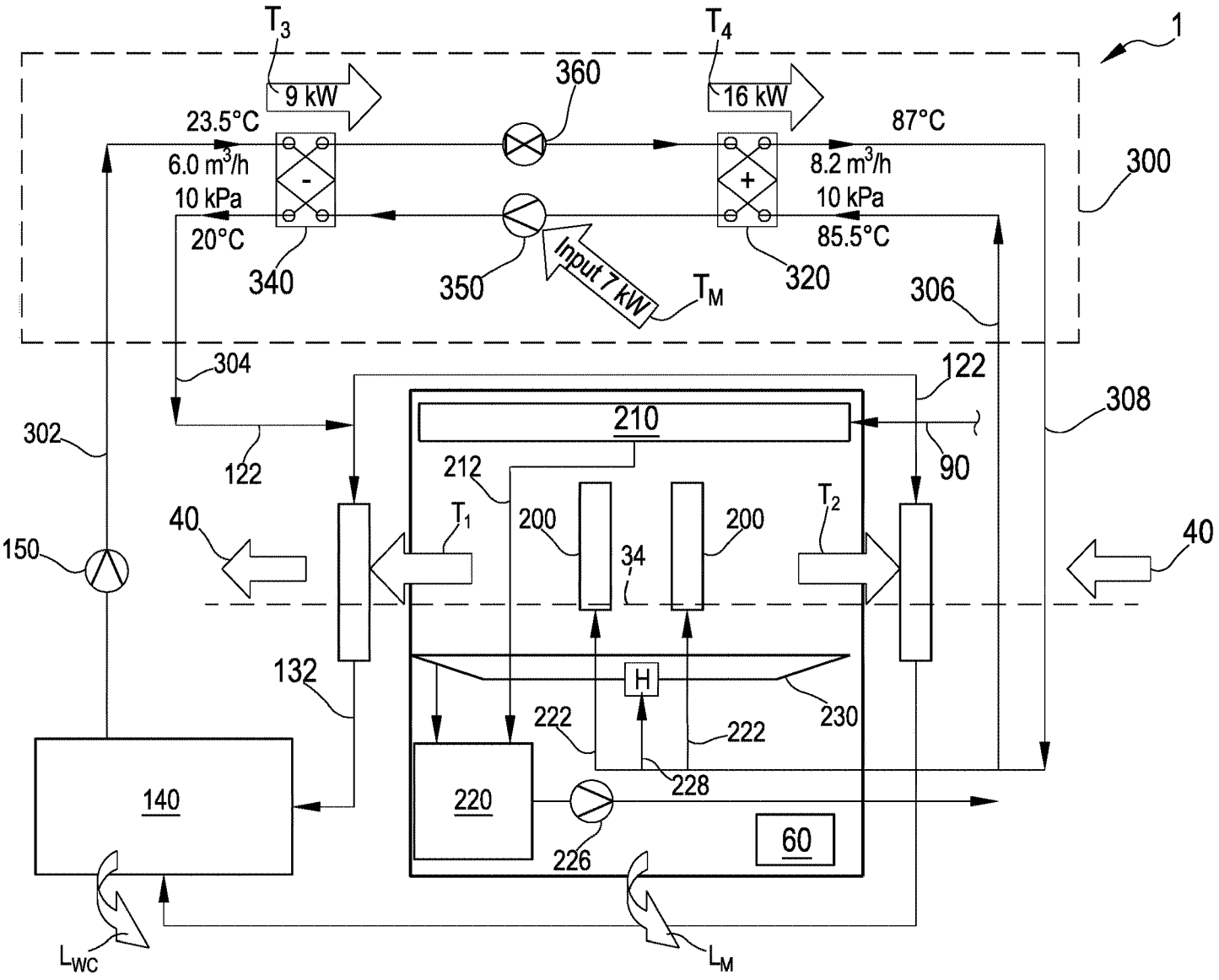
FIG. 2 shows a schematic overview of an apparatus for heat shrinking in accordance with a second embodiment of the present invention.

With respect to all figures, relative terms, such as "upper" or "lower", refer to a use configuration in which a conveyor belt 30 is configured to support a package 2 on an upper surface thereof (e.g. an upper surface or an upper run configured to support one or more packages 2) and to substantially horizontally move the packages 2 along a main movement direction 40 of packages 2 through apparatus 1. Similarly, relative terms, such as "above" and "below", pertain to said use configuration and define spatial relationships of components along a substantially vertical direction. In FIG. 1, for example, packages 2 are shown supported by (e.g. on top of) surface 34 and preheat container 210 is arranged above surface 34 in an upper region of chamber 10. Water curtains 100 and 200, for example, extend substantially vertically (e.g. substantially perpendicular to surface 34) as shown in FIGS. 1 and 2. Water curtains 200 may be formed from liquid that falls under gravity from a channel through which the liquid flows. The liquid may be water but this is not necessarily the case. The type of liquid that forms water curtains 200 or 100 is not particularly limited. Water curtain 200 may be formed by liquid falling out of a container filled by water from heat tank 220 and may be used to heat shrink package 2.

Preheat container 210 is configured to supply a preheated liquid to a heat tank 220 from which heating fluid is supplied to one or more hot water curtains 200 arranged within chamber 10. Preheat container 210 is arranged substantially above the surface 34, such that liquid in preheat container 210 can, during use, be preheated by heat rising up within chamber 10. Heat may be transferred from chamber 10 to preheat container 210 by conduction. Heat may further be transferred from the bottom of chamber 10 to preheat container 210 by convection. Preheat container 210 may be positioned such that the package 2 is between the surface 34 and the preheat container 210. In some embodiments, preheat container 210 may be arranged on top of chamber 10 or be realized as a component of an upper part of chamber 10 itself in order to receive heat in the manner described above. In yet other embodiments, the preheat container may be arranged in a different manner or the apparatus may not be provided with a preheat container.

Fresh water supply line 90 is configured to provide preheat container 210 with supply of fresh water and may be controlled, for example by means of a control unit 60 (not shown) to provide fresh water to preheat container 210 whenever a liquid level within preheat container 210 is below a predetermined minimum level, and to stop supply of fresh water to preheat container when the liquid level within preheat container 210 reaches or exceeds a predetermined maximum level. Preheated water from preheat container 210 may then be provided to heat tank 220 through a preheated water supply line 212. In some embodiments, fresh water supply line 90 is configured to continuously provide preheat container 210 with supply of fresh water, such that water contained in preheat container 210 is preheated as described above and continuously flows into heat tank 220 by means of an overflow channel. For example, preheated water supply line 212 may be configured to receive preheated water overflowing from preheat container 210 and to supply the preheated water to heat tank 220.

Hot water from heat tank 220 is heated by providing main heat transfer $T_M$ (e.g. heating energy provided by a water heater) to the water contained in heat tank 220. In a typical embodiment, the water in heat tank 220 is heated to a temperature of about 87° C. using main heat transfer $T_M$ of about 16 kW. It is noted that some embodiments and/or applications may require water having a different temperature and a corresponding different input of main heat transfer $T_M$. Water from heat tank 220 is then provided through hot water supply lines 222 to hot water curtains 200 by means of a pump 226. Pump 226, and/or other pumps (e.g. pump 150) or other components may be connected to and controlled by control unit 60. The control unit 60 may further be connected to a number of sensors and other components (e.g. valves) in order to detect the temperatures of water at different locations and in order to control pumps, valves, etc. accordingly. The control unit 60 may further be configured to control power supplied to the apparatus, for example controlling the main heat transfer $T_M$, in order to control the temperature of water within the system. The control unit 60 and individual connections to such pumps, valves, sensors, heaters, conveyors etc. are not shown in FIG. 1 for clarity. It is understood that the control unit 60 is connected to a number of such components in order to control operation of the apparatus, for example controlling one or more pumps (e.g. pumps 226, 150) to circulate fluid/liquid at certain rates, opening/closing valves, receiving signals from sensors, etc.

Water is further provided by pump 226 and line 228 to a collector 230 configured to receive water from hot water curtains 200 and to recirculate the collected water through line 232 back to heat tank 220. In this manner, hot water from heat tank 220 can be constantly circulated through hot water curtains 200 and collector 230 and back to heat tank 220 in order to maintain a desired temperature, for example of about 87° C. Heat loss, for example occurring at the hot water curtains (e.g. including the water being cooled by the air in chamber 10) and/or at the collector (e.g. including heat rising from the surface of the water in the collector, heating chamber 10), and heat loss occurring elsewhere in the system, may be countered by controlling main heat transfer $T_M$. In some embodiments heat tank 220 includes one or more heating units configured to heat liquid inside the heat tank 220. The heating units are not particularly limited and may be of any type suitable for heating liquid inside a container. The heating units may be powered by electrical energy, for example.

Heat loss originating substantially from the hot water circulating in chamber 10 may be schematically shown as heat transfer $T_1$ and $T_2$ caused by hot air and/or steam exiting chamber 10 through the inlet and/or outlet openings. Further, heat loss occurring throughout the apparatus 1, for example including an outer surface of chamber 10 and/or apparatus 1 heating up and radiating heat, may be schematically shown as $L_M$, indicating a corresponding machine heat loss $L_M$. In the embodiment shown in FIG. 1, a typical machine heat loss $L_M$ may be in the range of 7 kW and the heat loss $T_1$ and $T_2$ may each be in the range of 4.5 kW. It is noted that these values are provided merely for illustrative purposes and are not intended as limiting. Other values and ranges are equally applicable. It is further noted that some machine heat loss $L_M$ will necessarily occur, even if the apparatus 1 and/or components thereof are highly isolated and/or optimized in terms of heat loss.

Known designs may employ means to contain the heat in chamber 10 as described above, for example plastic curtains, which may have a rather limited effect for the reasons already discussed. In cases where such means are rather ineffective, based on the above-mentioned values and ranges a heat loss of about 9 kW (e.g. $T_1+T_2$) in addition to the machine heat loss $L_M$ may occur and, thus, lead to substantial disadvantages in terms of energy consumption of the corresponding apparatus.

However, apparatus 1 may be provided with one or more additional partitioning curtains, such as silicon curtains (i.e. a plurality of sheets of polymer, optionally partially overlapped; not shown), in order to partition off a section of the chamber 10 from the outside environment. The partitioning curtains may further thermally insulate the interior of the chamber 10 from the exterior of the chamber 10. There may be a substantial temperature difference between the interior of the chamber 10 and the exterior of the chamber 10. For example, in an embodiment the interior of the chamber 10 is maintained at a temperature within the range of from about 75° C. to about 100° C. and preferably within the range of from about 87° C. to about 92° C. On the other hand, in an embodiment the environment external to the apparatus 1 may be at a temperature of less than 30° C., optionally less than 20° C. and optionally about 10° C. The colder temperature outside of apparatus 1 may help to preserve the contents of package 2.

In some embodiments apparatus 1 may include one or more partitioning curtains inside chamber 10 through which packages 2 may pass when they are transported into and through chamber 10. In other embodiments, apparatus 1 may include at least two or more partitioning curtains within chamber 10 both at the inlet opening and the outlet opening, thereby providing additional layers of insulation.

In the center of chamber 10 depicted in FIG. 1, one or more hot water curtains 200 are provided for applying liquid heating fluid to packages 2 so as to heat shrink the packages 2. The water curtains 200 flow from low-pressure distributor channels. The driving force for the water curtains 200 is gravity. This helps to create a smoothly flowing water curtain 200. The packages 2 are transported into the chamber 10 onto the surface 34. When the packages 2 reach the water curtains 200 in the central region of the chamber 10, the packages 2 are subjected to the application of liquid heating fluid by hot water curtains 200. This causes the shrinkable packaging material surrounding the product to shrink around it, thereby shrinking the packages 2. After shrinking, the packages 2 are transported out from the chamber 10.

As mentioned above, in an embodiment the preheat container 210 is above the at least one channel. An advantage of this is that heat from the channel can rise upwards towards the preheat container 210 so as to preheat liquid in the preheat container 210. Accordingly, heat energy that would otherwise be wasted can be re-circulated in the system. The liquid that flows through the channels to form the water curtains 12 comprises liquid heating fluid 31. The liquid that forms the water curtains 12 is heated such that the water curtains 12 do not cause the temperature inside the chamber 10 to be reduced. Instead the water curtains 12 help to maintain the temperature inside the chamber 10.

The embodiment shown in FIG. 1, therefore, is provided with cold water curtains 100 at the inlet and outlet openings. Cold water curtains 100 are part of a cold water circuit that is configured to circulate water having a temperature substantially lower than the temperature within chamber 10 and/or the temperature of water in the hot water circuit. With respect to the exemplary values/ranges given above, the cold water circulating in the cold water circuit may be kept at a temperature of about 20° C. Cold water tank 140 is configured to hold a volume of cold water destined to be supplied to cold water curtains 100 by a pump 150 and through supply lines 122. Water may be supplied to cold water tank 140 by means of a fresh water supply line 90. Return lines 132 are configured to convey cold water collected from cold water curtains 100 back to cold water tank 140. Typically, the water circulating in the cold water circuit has a temperature above an ambient temperature so that cold water heat loss $L_{WC}$ may occur, indicating any heat loss incurred by heat dissipating from the cold water system to the ambient atmosphere.

Cold water curtains are arranged at the inlet and outlet openings of chamber 10, such that cold water curtains 100 effectively prevent air and/or steam from inside chamber 10 to come into direct contact with an ambient atmosphere outside chamber 10. As shown in FIG. 1, apparatus 1 is configured to receive packages 2, for example on the upper run 34 of a conveyor belt, and to convey packages 2 through a cold water curtain 100 at an inlet opening of chamber 10, through one or more hot water curtains 200, and through another cold water curtain 100 at an outlet opening of chamber 10. In this manner, apparatus 1 may move packages 2 through chamber 10 without subjecting packages 2 to contact with a plastic curtain (see above) and without allowing for direct contact between air and/or steam inside chamber 10 and an outside atmosphere. After exiting from chamber 10, packages 2 may undergo further processing, for example drying and/or bulk packaging.

The water running down cold water curtains complies to a shape or contour of packages 2 such that fluid communication between air and/or steam inside chamber 10 and an outside atmosphere is minimized or prevented. When no package 2 is in contact with one of the cold water curtains 100 (e.g. depending upon a spacing between packages being move through chamber 10), there is substantially no fluid communication between air and/or steam inside chamber 10 and an outside atmosphere due to the cold water curtains 100 substantially sealing the inlet and outlet openings.

Instead of dissipating into the ambient atmosphere, a portion of the heat from chamber 10 is kept within chamber 10 due to the lack of direct fluid communication between air and/or steam inside chamber 10 and the outside atmosphere. Further, a portion of the heat from chamber 10 is transferred (see $T_1$, $T_2$) to the water circulating in the cold water circuit. In this manner, air/steam is kept within chamber 10 and heat is dissipated into the water circulating in the cold water circuit. In this manner, the water circulating in the cold water circuit takes up heat and the mean temperature in the circuit may rise over time. The overall consumption of apparatus 1 according to the first embodiment shown in FIG. 1 can be substantially reduced by providing apparatus 1 with cold water curtains 100 as described.

The first embodiment shown in FIG. 1 may be provided with cold water curtains 100 arranged outside chamber 10. This may entail advantages with respect to cold water circulation, namely in that the water circulating in the cold water circuit may be maintained at a relatively cooler temperature and is not heated up in view of the relatively high temperature of air and steam present within chamber 10. This can entail substantial advantages with respect to overall power consumption of apparatus 1. Further, arranging cold water curtains outside chamber 10 may facilitate retro-fitting existing apparatuses. Other embodiments, however, may be provided with cold water curtains 100 arranged within chamber 10. This latter arrangement of cold water curtains may entail advantages with respect to more simple fluid handling within the apparatus, overall compactness of the apparatus, more simple design of the components creating the cold water curtains, or improved sealing properties of the cold water curtains.

FIG. 2 shows a schematic overview of an apparatus for heat shrinking in accordance with a second embodiment of the present invention. A key concept for operating the apparatuses schematically shown in FIGS. 1 and 2 efficiently is that the temperature of the water circulating in the hot water circuit is maintained at a first desired temperature configured to cause effective shrinking of the packaging material and that temperature of the water circulating in the cold water circuit is maintained at a second desired temperature configured to eliminate or reduce heat loss from chamber 10 and from the hot water circuit. One way to achieve this in the first embodiment shown in FIG. 1 is to provide the cold water circuit with a constant supply of fresh and cold water.

Generally, if the heat loss from the hot water circuit becomes too high (e.g. the temperature of the hot water circuit becomes too low), the overall efficiency of apparatus 1 decreases and/or shrinking may be negatively affected. If the temperature of the cold water circuit becomes too high, heat loss from the cold water circuit and/or from chamber 10 may increase, thus negatively affecting the efficiency of the apparatus. Therefore, it is desirable to maintain a controlled temperature differential between the hot water and the cold water.

This can be achieved as illustrated by the second embodiment shown in FIG. 2, by employing a heat pump 300. In the embodiment shown, heat pump 300 is provided with first and second heat exchangers 320 and 340, an expansion valve 360, and a compressor 350. Generally, heat exchangers 340 and 320 have two sets of inlet and outlet ports and are configured to transfer heat energy from a first fluid entering and exiting the heat exchanger trough the first set of inlet/outlet ports to a second fluid entering and exiting the heat exchanger through the second set of inlet/outlet ports. The heat pump circuit connecting compressor 350, first heat exchanger (or evaporator) 340, expansion valve 360, and second heat exchanger (or condenser) 320, typically operates on a working fluid other than water. It is noted, however, that heat pump 300 may include a corresponding heat pump known in the art and provided with the required power rating.

Heat exchanger 340 is configured to receive cold water from cold water tank 140 through a first inlet line 302 and to provide the cold water to the cold water circuit 122 through a first outlet line 304. The cold water is supplied to the heat pump 300 and, in particular, to the first heat exchanger 340, by pump 150. Internally to heat pump 300, the first heat exchanger 340 receives and outputs the working fluid from and to the heat pump circuit, thereby transferring heat energy from the cold water circuit to the heat pump circuit. The first heat exchanger 340 receives the cold water at a first temperature and outputs the cold water at a second temperature lower than the first temperature, the temperature difference depending on the heat transferred from the cold water. In one example, the temperature of cold water received is about 23.5° C. and the temperature of cold water output is about 20° C.

The control unit is configured to control compressor 350 and expansion valve 360 in order to regulate the heat pump 300 and the heat transferred by it. In the present example, operating heat pump 300 requires an input of about 7 kW, which corresponds to the main heat transfer $T_M$ induced into the hot water circuit.

Heat exchanger 320 is configured to receive hot water from hot water tank 220 and pump 226 through a second inlet line 306 and to provide the hot water to the hot water circuit 222 through a second outlet line 308. The hot water is supplied to the heat pump 300 and, in particular, to the second heat exchanger 320, by pump 226. Internally to heat pump 300, the second heat exchanger 320 receives and outputs the working fluid from and to the heat pump circuit, thereby transferring heat energy from the heat pump circuit to the hot water circuit. The second heat exchanger 320 receives the hot water at a first temperature and outputs the hot water at a second temperature higher than the first temperature, the temperature difference depending on the heat transferred from the working fluid. In the present example, the temperature of hot water received is about 85.5° C. and the temperature of hot water output is about 87° C.

As can be seen from FIG. 2, heat transfers $T_1$ and $T_2$ from chamber 10 to cold water curtains 100 are substantially compensated by the heat transfer $T_3$ (by means of the first heat exchanger) from the cold water in the cold water circuit to the working fluid of heat pump 300. In the present example, the heat transfer $T_3$ is about 9 kW. In addition, the power input provided to compressor 350—in the present example about 7 kW—is added to the total energy transferred, which leads to the second heat exchanger 320 providing the hot water circuit with a total heat transfer $T_4$ of about 16 kW. In addition to the benefits provided by cold water curtains 100 as described above with respect to the first embodiment shown in FIG. 1, the overall consumption of apparatus 1 according to the second embodiment shown in FIG. 2 can be further substantially reduced by providing apparatus 1 with a heat pump 300 as described.

Figure 3:
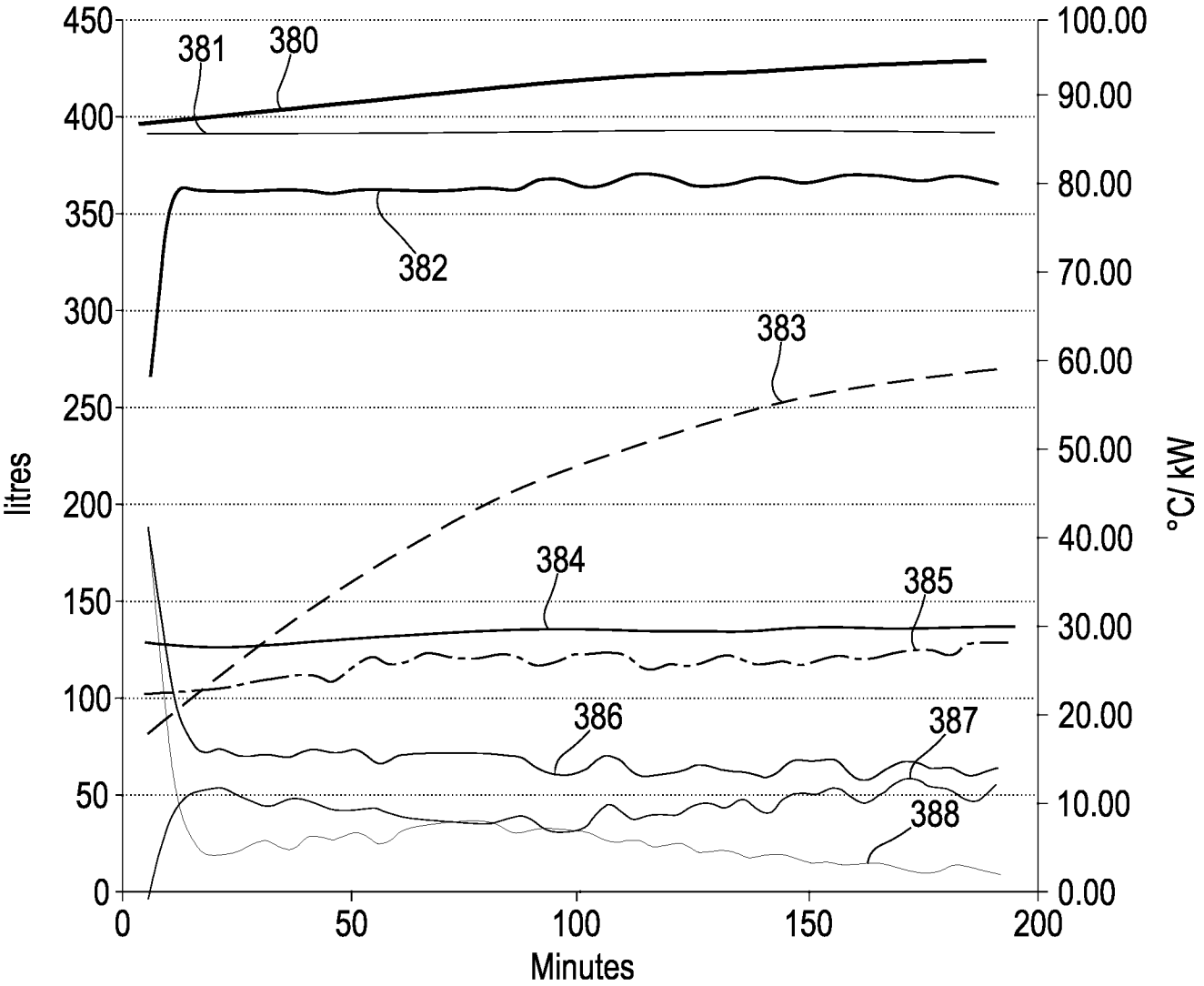
FIG. 3 shows diagram illustrating exemplary operating temperatures and power consumptions of an apparatus for heat shrinking in accordance with the first embodiment of the present invention.

FIG. 3 shows diagram illustrating exemplary operating temperatures and power consumptions of an apparatus for heat shrinking in accordance with the first embodiment of the present invention. The diagram in FIG. 3 shows typical values and value ranges for several different operating parameters of an apparatus 1 according to the present invention. The graphs for the different parameters show values over time, as indicated on the horizontal axis, describing the values over a period of 200 minutes of operation. The vertical axis shows units for liters (see left side of the diagram) and the units for ° C. and kW (see right side of diagram). The different parameters have been measured based on a testing configuration of apparatus 1 according to the first embodiment, the ambient temperature for testing was between 23° C. and 26° C.

The cold water circuit is characterized by graph 380, indicating the total volume in liters (l) of cold water in the cold water circuit, and by graph 383, indicating the temperature in degrees Celsius (° C.) of the water in the cold water circuit. The total volume in liters (l) of hot water in the hot water circuit is indicated by graph 384. As can be seen, the total volume of cold water rises slowly, as water continuously dissipates from the hot water circuit into the cold water circuit. Steam present in chamber 10 tends to condensate at the cold water of cold water curtains 100 and, thus, adds to the water in the cold water circuit at a rate of about 10 l/h. The temperature of the cold water rises over time, as the water in the cold water circuit receives heat energy dissipating from the air and steam present in chamber 10 into water running down water curtains 100. The asymptotic shape of graph 383 shows that, over time, an equilibrium state may be reached, depending, inter alis, upon the temperature of the hot water, the temperature of the cold water, and the ambient temperature. However, concrete values depend on a number of additional factors and the individual application.

Graphs 382 and 385, respectively, indicate the temperature of the air within chamber 10 (382), which, after an initial warm-up phase (e.g. during the time up to about 20 minutes from the start of the apparatus), remains throughout operation at about 80° C., and the ambient air temperature (385), which is between 23° C. and 26° C. A slight rise in the ambient temperature can be caused by heat dissipating from the entire apparatus and warming the surrounding air. The shrink temperature, graph 381, is set at a constant 87° C. Other applications may require a shrink temperature different from what is shown in this example.

After the initial warm-up phase, during which power consumption is briefly increased as to reach specific temperature for different components of apparatus 1, the power consumption (graph 386) steadily decreases from about 17 kW to about 14 kW while the net heat transfer (graph 387) slowly increases from about 5 kW to about 11 kW. The difference between the power consumption 386 and the net heat transfer 387, indicated by graph 388, consequently develops from about 12 kW to about 3 kW.

Figure 4:
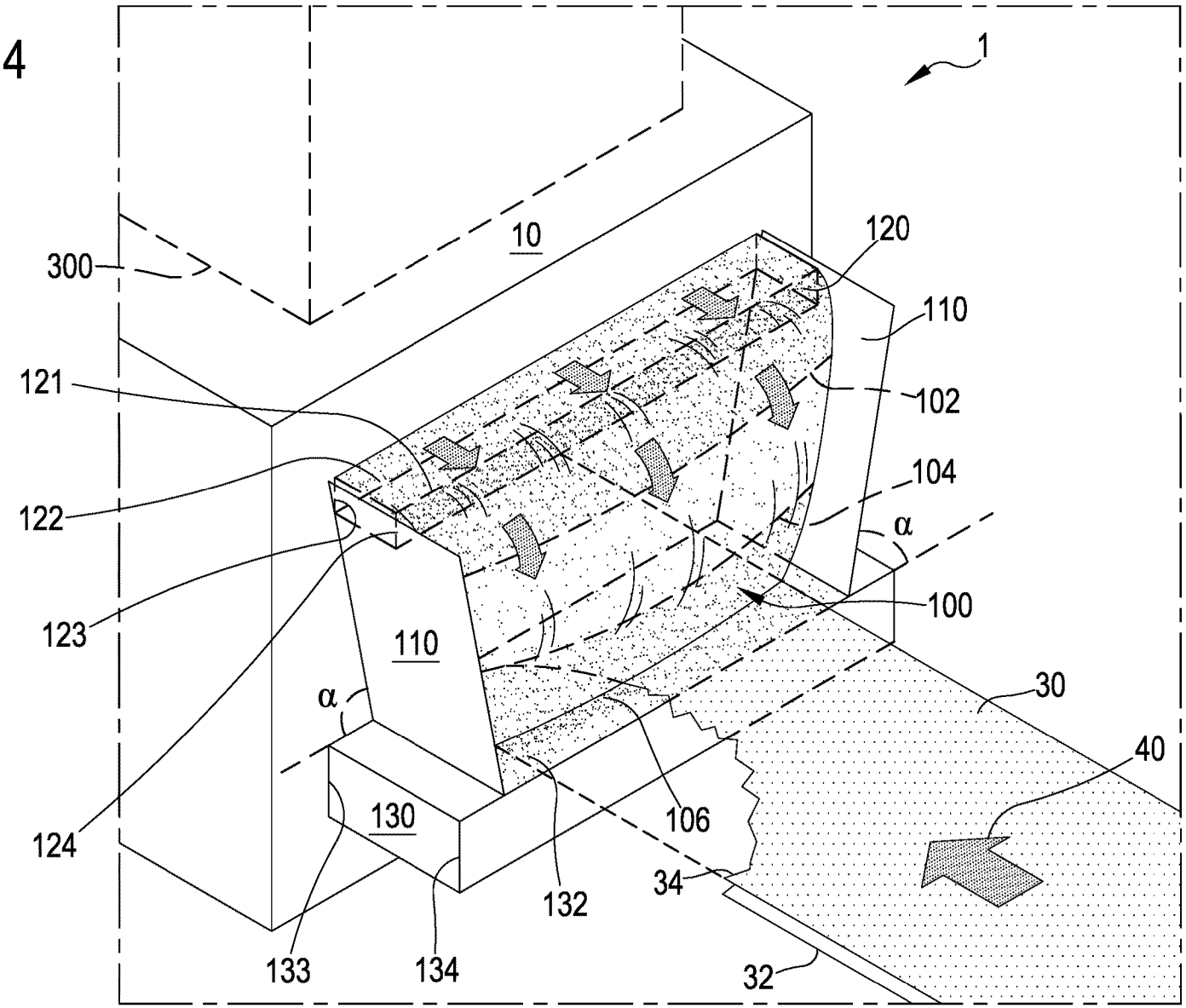
FIG. 4 shows an isometric view of an apparatus for heat shrinking in accordance with embodiments of the present invention.

FIG. 4 shows an isometric view of an apparatus for heat shrinking in accordance with embodiments of the present invention. The apparatus 1 as shown in FIG. 4 may correspond to the apparatus 1 as shown in FIGS. 1 and 2 and, thus, may be an apparatus in accordance with both the first and second embodiments. Hence, the heat pump 300 shown on top of apparatus 1 of FIG. 4 is shown using dashed lines, indicating that providing apparatus 1 with a heat pump is optional. FIG. 4 serves to illustrate an embodiment of cold water curtain 100 arranged outside of chamber 10 and to detail specific aspects associated thereto.

As can be seen, cold water curtain 100 includes an upper reservoir 120 and a lower reservoir 130. The upper reservoir 120 is configured to hold a volume of cold water and is effectively part of supply line 122 supplying cold water from cold water tank 140 to cold water curtain 100. As can be seen, the water level within upper reservoir 120 is flush with an outer edge thereof, which is arranged above the inlet opening (see main movement direction 40 as indicated in connection with the conveyor belt 30) of chamber 10, such that excess cold water, which is continuously supplied to upper reservoir 120 by pump 150 spills over the outer edge, downwards towards the lower reservoir 130. The water forms a closed cold water curtain 100 and flows through the upper run 34 of conveyor belt 30, which is configured to support packages 2 but to let water pass through (e.g. by means of a mesh structure, an open web or textile, etc.). Water is accumulated within lower reservoir 130, which is configured to hold a volume of water and is effectively part of the return line 132.

Upper reservoir 120 has a first end 123 and a second end 124. First end 123 is proximate to and abuts chamber 10. First end 123 may further be in fluid communication with supply line 122 either from within chamber 10 or outside of chamber 10. Supply line 122 is not shown in FIG. 4. Second end 124 is arranged opposite first end 123 of upper reservoir 120 (or distal to chamber 10) and comprises an outer edge 121. Outer edge 121 is substantially straight and oriented substantially horizontally such that under substantially continuous supply of liquid to upper reservoir 120, excess liquid flows over outer edge 121 in form of a substantially continuous liquid curtain, towards and into lower reservoir 130.

Lower reservoir 130 also has first 133 and second 134 ends, the first end being proximate chamber 10, preferably abutting chamber 10, and the second end being arranged distal to chamber 10. Second end 134 is further arranged spaced from chamber 10 at a larger distance than second end 124 of upper reservoir 120 in order to collect liquid flowing over outer edge 121 of upper reservoir 120.

In some embodiments, upper 120 and lower 130 reservoirs may be arranged partly inside chamber 10, without the structure being substantially different form what is shown in FIG. 4. A side wall of chamber 10 may be configured to provide an opening for liquid inside the upper 120 and lower 130 reservoirs to flow from the part of the respective reservoir located within chamber 10 to the part of the respective reservoir located outside chamber 10, without providing fluid communication between an inner volume inside chamber 10 and an ambient atmosphere external to chamber 10. In still other embodiments, upper 120 and lower 130 reservoirs, as well as panels 110, may be arranged fully inside chamber 10. In such embodiments, the liquid curtain may be formed inside chamber 10 in a manner corresponding to what is shown in FIG. 4, thereby in the same manner limiting of preventing fluid communication between an inner volume within chamber 10 and an ambient atmosphere external to chamber 10. Arranging the cold water curtains outside chamber 10 may entail advantages in terms of energy requirements, based on the liquid being heated less on the outside of chamber 10, as compared to inside chamber 10.

Panels 110 are generally configured to provide a smooth transition for the liquid flow from upper reservoir 120 to lower reservoir 130. In particular, panels 110 are configured to create a laminar flow of liquid from upper reservoir 120 to lower reservoir 130, thereby ensuring that the liquid curtain is formed as a continuous wall of liquid also in the lateral regions thereof, adjacent to the panels. To this aim, the panels 110 are configured to cause adhesion of the flow of liquid to the panels 110.

A significant effect illustrating the efficiency of cold water curtains 100 can be seen from dashed lines 102 and 104, as well as line 106. The cold water curtains 100 provide an effective barrier and prevent or minimize fluid communication between the inner volume of chamber 10 and the ambient atmosphere. In order to achieve this effect, the cold water curtains 100 should form a substantially continuous film of water covering the inlet and outlet openings of chamber 10. This can be facilitated by providing the upper reservoir 122 with an outer edge adjusted to be substantially horizontal and by supplying the upper reservoir 122 with a constant supply of cold water.

As the higher temperature air and/or steam tries to escape from chamber 10, the fluid pushes against the cold water curtains, thereby pushing the water curtain outwardly from inside chamber 10. Lines 102 and 104, forming a slightly arched profile, illustrate this effect. However, since a water curtain does not posses a significant tensile modulus, lateral panels 110 may be provided at the sides of the inlet/outlet openings at an angle with respect to a vertical orientation, such that lower ends of panels 110 are closer together than upper ends thereof. This may allow for the cold water curtain 100 to slightly deform outwardly without the water curtain collapsing (e.g. including having slits or holes). Each panel 110 is preferably arranged at an inclination angle $\alpha$ of about 75° to 85° with respect to a horizontal plane substantially parallel to active surface 34, more preferably at an inclination angle $\alpha$ of about 80°, such that panels 110 provide the region in which the liquid curtain is formed with a slightly funnel-shaped form. Upper ends of panels 110 are spaced apart slightly more than lower ends of panels 110.

Having cold water curtains 100 assume a slightly convex shape during operation of apparatus 1 may indicate an effective sealing and/or insulation of the inner volume of chamber 10 from the ambient atmosphere and, thus, it may indicate apparatus 1 operating efficiently. Line 106 indicates where the liquid from the cold water curtain flows through active surface 34 and enters the liquid contained in lower reservoir 130. Active surface 34 is configured to be sufficiently permeable such that the liquid can easily flow through but at the same time to well support packages 2.

Apparatus 1 comprises a control unit (not shown) configured to control operations of the apparatus 1. In some embodiments the control unit is configured to control the supply of heating fluid from heat tank 220 to chamber 10. The control unit may control pump 226 so as to supply appropriately the heating fluid to chamber 10. The control unit may be provided in a housing unit that comprises chamber 10. However, this needs not necessarily be the case. In some embodiments the control unit may be provided as a unit separate from the housing unit of apparatus 1.

As shown in FIGS. 1 and 2, the heat tank 220 may be arranged below the surface 34 such that gravity may drive the movement of the preheated liquid from the preheat container 210 to the heat tank 220. An advantage of providing the heat tank 220 below the surface 34 may include that the resulting system is simple and allows the preheated liquid to transfer efficiently from the preheat container 210 to the heat tank 220. This simple system does not require any further device that could require additional energy in order to transfer the preheated liquid to the heat tank 30. This helps to reduce the energy consumption of the apparatus 1.

Additionally, by positioning the heat tank 220 below the surface 34, excess heating fluid within chamber 10 may flow downwards into the heat tank 220 under gravity. For example, heating fluid that has been used by a hot water curtain 200 may flow back into the heat tank 220 efficiently. This helps to reduce the amount of heat that is lost from the heating fluid between the time that it is used in the chamber 10, e.g. in a water curtain 200 and the time that it is received into the heat tank 200.

The rate of supply of external liquid to the preheat container 210 may be directly related to the rate at which preheated liquid is supplied from the preheat container 210 to the heat tank 220. In this manner, the level of heating fluid in heat tank 220 may be maintained at an approximately constant level.

Surface 34 may be an upper surface of a conveyor belt 30 configured to transport packages 2 into and/or out from chamber 10. Accordingly, packages 2 may be supplied continuously through the chamber 10 for heat shrinking. The transportation of the packages 10 may be automated.

Surface 34 may include a mesh structure, an open web/textile, holes and/or be porous such that liquid heating and cooling fluid may pass through surface 34. The conveyor belt 30 may comprise a mesh surface. This allows the excess liquid heating fluid to pass back into the heat tank so as to be re-circulated within the system.

Apparatus 1 may form part of a packaging system, which may include a dryer (not shown) configured to dry packages 2 that have been heat shrunk by apparatus 1 for heat shrinking packages 2. The dryer may be configured to blow gas onto the packages 2 so as to dry the packages 2. The gas may be air, for example. The gas may be heated. The dryer may dry packages 2 that have heating/cooling fluid remaining on them from the apparatus 1.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. An apparatus for heat shrinking packages, comprising:

a mover having an active surface configured to receive one or more packages and to displace the one or more packages along a predetermined operating path;

a heating fluid circuit configured to circulate a heating fluid;

a cooling liquid circuit configured to circulate a cooling liquid;

a control unit operative on the heating fluid circuit and operative on the cooling fluid circuit, the control unit being configured to control circulation of the heating fluid in the heating fluid circuit, and the control unit being configured to control circulation of the cooling liquid in the cooling liquid circuit;

a chamber having an opening and being configured to receive the one or more packages positioned on the active surface and to heat shrink the one or more packages based on circulation of the heating fluid in the heating fluid circuit; and a system configured to form a liquid curtain arranged at the opening and configured to define a liquid curtain along the opening, the liquid curtain separating an inner volume of the chamber from an ambient atmosphere external to the chamber;

wherein the control unit is configured to control the cooling liquid circuit to supply the cooling liquid to the liquid curtain.

2. The apparatus of claim 1, wherein:

the system configured to form the liquid curtain comprises an upper reservoir and a lower reservoir; and the system configured to form the liquid curtain is configured to create, under gravity, the liquid curtain in the form of a substantially continuous wall of liquid extending between the upper reservoir and the lower reservoir based on a substantially continuous supply of cooling liquid from the cooling liquid circuit, thereby separating the inner volume of the chamber from the ambient atmosphere external to the chamber.

3. The apparatus of claim 2, wherein the control unit is configured to control the substantially continuous supply of cooling liquid from the cooling liquid circuit to the system configured to form the liquid curtain.

4. The apparatus of claim 2, wherein the upper reservoir and the lower reservoir are relatively positioned with respect to one another so as to cause, under the substantially continuous supply of cooling liquid from the cooling liquid circuit to the upper reservoir, flow of the cooling liquid over an outer edge of the upper reservoir and into the lower reservoir, thereby forming the substantially continuous wall of liquid extending between the upper reservoir and the lower reservoir.

5. The apparatus of claim 2, wherein the upper reservoir has a first end and a second end and is positioned relative to the apparatus such that the first end of the upper reservoir is positioned proximate to or within the chamber and such that the second end of the upper reservoir is positioned distal to the chamber, the outer edge of the upper reservoir being located at the second end of the upper reservoir and.

6. The apparatus of claim 2, wherein at least one of the upper reservoir and the lower reservoir is configured to hold a volume of the cooling liquid.

7. The apparatus of claim 2, wherein the system configured to form the liquid curtain further comprises at least two panels configured to laterally guide the cooling liquid and extending laterally to a region in which the liquid curtain is formed between the upper reservoir and the lower reservoir.

8. The apparatus of claim 1, wherein the cooling liquid circuit comprises:

a cooling liquid tank;

a pump; and a cooling liquid supply line;

wherein the control unit is configured to control the pump in order to cause controlled supply of the cooling liquid to the system configured to form the liquid curtain via the cooling liquid supply line.

9. The apparatus of claim 1, wherein the system configured to form the liquid curtain is arranged outside of the chamber substantially adjacent the opening.

10. The apparatus of claim 1, wherein the system configured to form the liquid curtain is arranged inside of the chamber substantially adjacent the opening.

11. The apparatus of claim 1, further comprising a heat pump; wherein the control unit is further configured to control the heat pump to cause transfer of heat energy from the cooling liquid circulating in the cooling liquid circuit to the heating fluid circulating in the heating fluid circuit.

12. The apparatus of claim 11, wherein the heat pump comprises a heat pump circuit configured to circulate a working fluid, the heat pump circuit comprising:

a first heat exchanger;

a second heat exchanger;

an expansion valve; and a compressor;

wherein the first heat exchanger is configured to transfer heat from the cooling liquid circulating in the cooling liquid circuit to the working fluid circulating in the heat pump circuit;

wherein the second heat exchanger is configured to transfer heat from the working fluid circulating in the heat pump circuit to the heating fluid circulating in the heating fluid circuit; and wherein the control unit is configured to control the expansion valve and/or the compressor in order to cause heat energy transfer from the cooling liquid circulating in the cooling liquid circuit to the heating fluid circulating in the heating fluid circuit via the working fluid circulating in the heat pump circuit.

13. The apparatus of claim 1, wherein the chamber further has a second opening and is configured to receive the one or more packages through the opening and for allowing the one or more packages to exit the chamber through the second opening; and wherein the apparatus further comprises:

a second system configured to form a second liquid curtain connected to the cooling liquid circuit, the second liquid curtain arranged at the second opening, wherein the liquid curtain and the second liquid curtain separating the inner volume of the chamber from the ambient atmosphere external to the chamber;

wherein the control unit is configured to control the cooling liquid circuit to supply the cooling liquid to the system configured to form the liquid curtain and to the second system configured to form the second liquid curtain.

14. An apparatus for heat shrinking packages, comprising:

a mover having an active surface configured to receive one or more packages and to displace the one or more packages along a predetermined operating path;

a heating fluid circuit configured to circulate a heating fluid;

a cooling liquid circuit configured to circulate a cooling liquid;

a control unit operative on the heating fluid circuit and operative on the cooling fluid circuit, the control unit being configured to control circulation of the heating fluid in the heating fluid circuit, and the control unit being configured to control circulation of the cooling liquid in the cooling liquid circuit;

a chamber having an opening and being configured to receive the one or more packages positioned on the active surface and to heat shrink the one or more packages based on circulation of the heating fluid in the heating fluid circuit; and a system configured to form a liquid curtain arranged at the opening and configured to define a liquid curtain along the opening, the liquid curtain separating an inner volume of the chamber from an ambient atmosphere external to the chamber;

wherein:

the control unit is configured to control the cooling liquid circuit to supply the cooling liquid to the liquid curtain formed;

the mover comprises a conveyor belt;

the control unit is further configured to control the conveyor belt in order to transport packages into and/or out from the chamber;

the active surface includes an upper surface of the conveyor belt; and the active surface comprises a mesh, holes, and/or a porous surface such that the heating fluid can pass through the active surface.

15. A method for heat shrinking a package, the method comprising:

providing one or more packages on an active surface of a mover configured to receive the one or more packages on the active surface and to displace the one or more packages along a predetermined operating path;

defining a liquid curtain along an opening of a chamber of an apparatus, the liquid curtain separating an inner volume of the chamber from an ambient atmosphere external to the chamber, the liquid curtain being a substantially continuous supply of a cooling liquid via a cooling liquid circuit configured to circulate the cooling liquid;

moving the one or more packages through the liquid curtain and through the opening into the chamber; and heat shrinking the one or more packages on the active surface within the chamber, wherein the heat shrinking is based on circulation of a heating fluid in a heating fluid circuit in the chamber.

16. The method of claim 15, wherein a system configured to form the liquid curtain is arranged at the opening and configured to define the liquid curtain along the opening.

17. The method of claim 16, further comprising:

the step of defining the liquid curtain comprises controlling the cooling liquid circuit to supply the cooling liquid to the system configured to form the liquid curtain.

18. The method of claim 16, wherein the step of heat shrinking the one or more packages comprises controlling the heating fluid circuit to circulate the heating fluid to cause application of the heating fluid to the one or more packages.

* * * * *